United States Patent [19]

Fahrendorf et al.

[11] 4,173,840

[45] Nov. 13, 1979

[54] TURRET TOY VEHICLE

[75] Inventors: Curtis H. Fahrendorf, Anoka; Delmar D. Berckhan, Wayzata, both of Minn.

[73] Assignee: Tonka Corporation, Spring Park, Minn.

[21] Appl. No.: 801,750

[22] Filed: May 31, 1977

[51] Int. Cl.[2] ..... A63H 17/08

[52] U.S. Cl. ..... 46/202; 46/215

[58] Field of Search ..... 46/202, 215

[56] References Cited

U.S. PATENT DOCUMENTS 3,731,428 5/1973 Glass et al. ..... 46/215

FOREIGN PATENT DOCUMENTS 763424 12/1956 United Kingdom ..... 46/215

*Primary Examiner*—Louis G. Mancene
*Assistant Examiner*—Robert F. Cutting
*Attorney, Agent, or Firm*—Norman P. Friederichs

[57] ABSTRACT

A toy fire engine is disclosed including a body, wheel and axle assembly, aerial ladder, ladder support and loose ladder. The ladder support may include a turret for pivotal support of the ladder about a vertical axis. The fire engine body may include a ladder carrier which limits sideward movement and linear movement of a loose ladder when disposed in the carrier.

16 Claims, 7 Drawing Figures

FIG. I
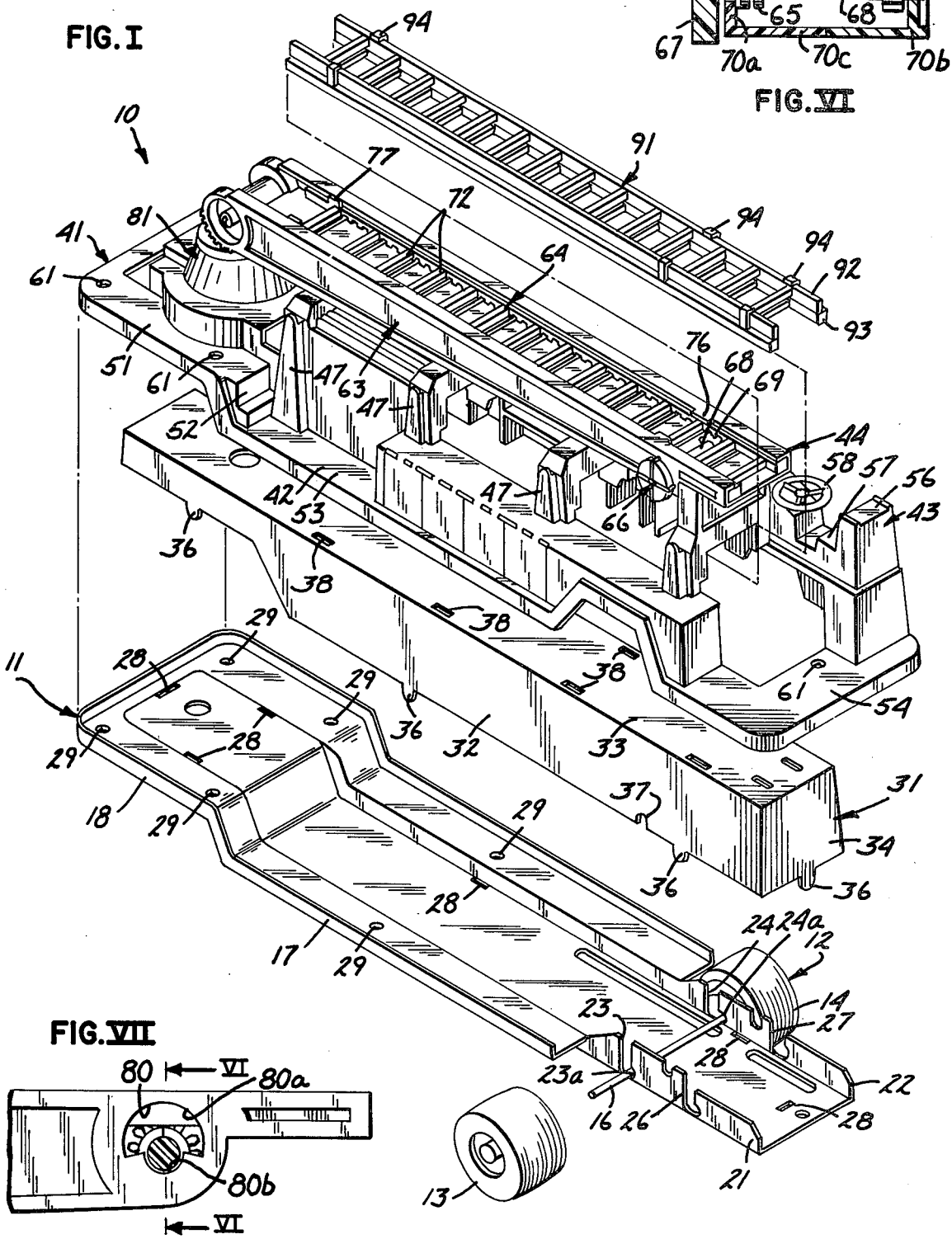
FIG. VI
FIG. VII

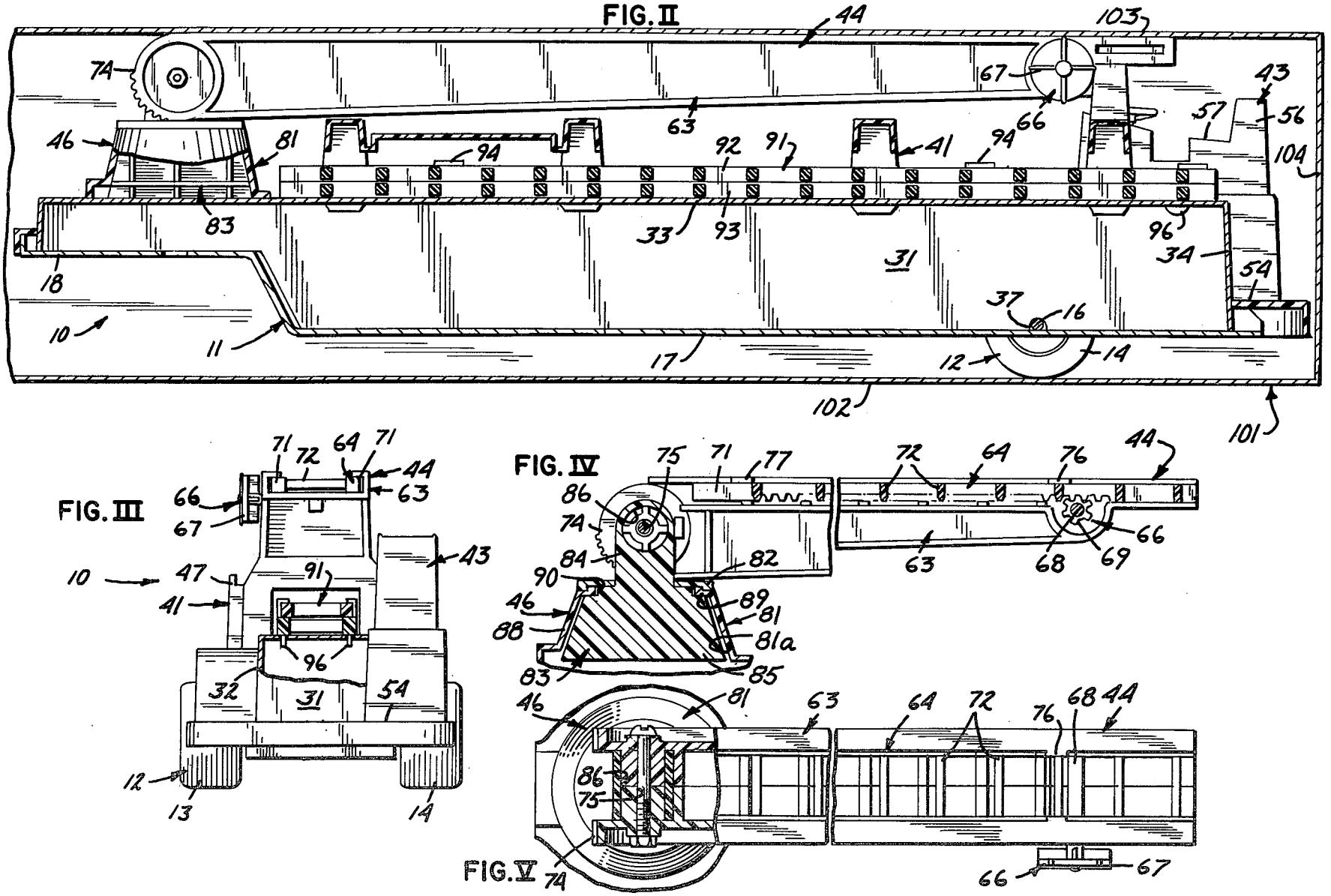
FIG. II
FIG. III
FIG. IV
FIG. V

TURRET TOY VEHICLE

BACKGROUND OF THE INVENTION

The present invention relates to toy vehicles and more particularly to toy fire engines including aerial ladders.

One highly desirable toy fire engine is shown in U.S. Pat. No. 3,735,528. It shows an aerial ladder for a toy fire truck including a bracket for mounting the ladder to a truck body. The disclosed mounting uses a pin on which the ladder bracket is pivotal. Such fire truck extension ladder has a crank and gear device for changing the angular elevation of the ladder thereby raising and lowering the aerial ladder.

In the past, a variety of other toy fire engines have been available with extension ladders and resembling full sized fire engines. Such toy fire trucks or engines have typically included loose ladders which the child may handle and position during play. Such ladders add substantially to the child's enjoyment of the toy. Toy store operators have encountered difficulties with respect to such ladders in that the loose ladders are often lost due to shoplifting. Thus, there is a recognized need for developing an approach whereby loose ladders may be secured with regard to the fire truck at least until the toy is sold. Moreover, during play, the child may encounter some difficulty in maintaining the loose ladders on the fire truck as the child maneuvers the fire truck about.

SUMMARY OF THE PRESENT INVENTION

The present invention is a toy truck or engine including a turret pivot mounting. The present invention may be a fire engine including a body, a wheel and axle assembly, an aerial ladder with pivotal mounting and one or more loose ladders.

The pivot mounting may be a turret including a first cylindrical or frustoconical portion which is part of the body of the truck or engine. The frustoconical portion may have an opening in the upper side through which an aerial ladder support may extend. The turret may include a second frustoconical portion which is rotatably mounted in the first frustoconical portion. A boom or ladder support extends from the upper side of the second frustoconical member and may be integral therewith. The second frustoconical member may be vertically locked with respect to the first frustoconical member by the support or by any other method, for example, by a support member beneath the second frustoconical member. The boom or aerial ladder may be secured to the support for rotational movement with the second frustoconical member.

Although the present invention is disclosed with regard to a fire engine, certain aspects of the invention have broader application. For example, the toy vehicle with the turret may be a so-called "cherry picker" toy truck and the turret used to simulate support of a person in an elevated carrier on a boom such as to repair telephone lines or pick fruit. Alternatively, the turret may be used on a toy wrecker or drag-line to support a boom.

The toy fire engine may further include one or more loose ladders which may be mounted on, or removed from the toy fire engine. The body of the truck may have lateral guides for limiting sideward movement of the ladder when disposed on the truck. The loose ladder may have a flange extending therefrom for engagement in a slot in the body of the fire engine to control linear movement of the loose ladder.

In the Drawings:

FIG. I is an exploded perspective view of the present fire truck;

FIG. II is a cross-sectional view of the toy fire truck trailer disposed in a container;

FIG. III is a rear view of the invention with a portion broken away;

FIG. IV is a cross-sectional view of the aerial ladder and turret;

FIG. V is a top view of the aerial ladder and turret;

FIGS. VI and VII are views of a portion of the ladder.

DETAILED DESCRIPTION OF THE PRESENT INVENTION

The fire engine or fire engine trailer 10 of the present invention (one preferred embodiment of which is shown in FIGS. I–V) may include a lower body frame 11 with wheel and axle assembly 12 including a pair of wheels 13, 14 and axle 16. In the fire engine trailer shown in FIG. I, the lower body frame 11 may include a first portion 17 and a raised second portion 18. The portion 17 provides a bed for a major portion of the fire engine trailer 10 and portion 18 provides for attachment to a truck tractor such as by a fifth wheel arrangement. The present invention may be in the form of a trailer suitable for attachment to a truck tractor. Alternatively, the present invention may be a straight truck-type fire engine. The term "fire engine" as used herein will refer to both the tractor-trailer and the straight truck types.

Portion 17 of body frame 11 may include a pair of upwardly extending flanges 21, 22, each having a slot therein 23, 24 respectively, for reception of axle 16. The slots 23, 24 may have rearwardly extending portions **23*a*, 24*a*, respectively, for purposes hereinafter set forth. The flanges 21, 22 may include a similar second pair of slots 26, 27 for reception of a second wheel and axle assembly thereby making a tandem fire engine trailer. The lower body frame 11 may include a plurality of small rectangularly-shaped openings 28 and a plurality of circular openings such as 29** for purposes hereinafter described.

The fire engine trailer 10 may include an intermediate body frame 31 which may be substantially rectangular in shape including a pair of sidewalls, such as sidewall 32, having a lower edge suitable for mating with frame 11, an upper wall 33 and a rear wall 34. The sidewalls such as 32 and rear wall 34 may have downwardly extending tabs 36 which cooperate with the openings 28 in a lower body frame 11. In other words, the tabs 36 may be inserted through openings 28 and then bent thereby locking intermediate body frame 31 to lower body frame 11. The sidewalls, such as 32, further include openings 37 which cooperate with slots 23 and 24 in frame 11 to secure wheel assembly 12 in place. The intermediate body frame 31 may have a plurality of rectangularly-shaped openings 38 in upper surface 33. The metallic intermediate body frame 31 serves as a beam or strengthening member in the fire engine trailer 10.

The upper body member 41 may simulate the exposed portions of a fire engine and has a walkway 42, a ladder operator seat 43, an aerial ladder 44, a turret 46 and a plurality of ladder carriers 47. The walkway 42 may extend around the periphery of the fire engine trailer 10 and may include a forward raised portion 51, steps 52 leading down to a side portion 53 and a rear portion 54.

The seat 43 for the aerial ladder operator may include a backrest portion 56 and a bench seat 57. A control wheel 58 may also be provided for the aerial ladder operator.

The upper body member 41 may be suitably secured to lower frame 11 and/or intermediate frame 31. The lower side of body member 41 may include a plurality of downwardly extending tabs for engagement in openings 38. The body member 41 may further include a plurality of openings 61 for alignment with openings 29 in lower body frame 11. Fastening devices such as screws or bolts (not shown) may be inserted through openings 61 and 29 for securing body member 40 to lower frame 11.

The aerial ladder 44 may include a first section 63 and a second section 64. The ladder section 63 may have a wheel and gear assembly 66 at the upper end thereof for driving engagement with ladder section 64. The assembly 66 may include a wheel 67, a shaft 68, a smooth wheel 65, and a toothed gear 69. The ladder section 64 may have a pair of parallel side members 71 and a plurality of steps or rungs 72. At least one of the side members 71 is toothed for driven engagement with gear 69. One end of ladder section 63 may include a friction hub 74. The ladder section 63 may include a pair of parallel side members **70*a* and 70*b* interconnected by steps or rungs 70*c*. The side member 70 *a* may have an opening 75 (FIG. VI) therein for rotatable reception of one end of shaft 68. The other side member 70*b* has an opening 80 (FIG. VII) therein for receiving and supporting the assembly 66. The opening 80 includes a large arcuately shaped portion 80*a* and a smaller arcuately shaped portion 80*b*. The opening portion 80*a* is of sufficient size to permit insertion of the toothed gear 69 through the opening 80. The opening portion 80*b* is of appropriate size to rotatably support the shaft 68 as shown in FIG. VII. The assembly 66 is held in place in opening portion 80*b* by ladder section 64. In other words ladder section 64 rides in channels 70*a*′ and 70*b*′ of ladder section 63 thus trapping assembly 66 between sections 63 and 64. The smooth wheel 65 may engage a ridge on one of the side members 71 thus preventing sideward movement of assembly 66 with respect to aerial ladder 44**.

The ladder sections 63 and 64 may be locked together in such a manner that they cannot be easily separated. The ladder section 63 may have a projection 76 and ladder section 64 has a projection 77. The projections are aligned and cannot bypass each other. In other words, when section 64 is fully extended, projection 76 abuts projection 77 and cannot pass by. The projections 76 and 77 thus cooperate to prevent removal or separation of the ladder sections 63 and 64.

The turret 46 (FIG. IV) may include a first hub portion 81 which preferably is frustoconical in shape and defines internally a cavity **81*a*. The portion 81 is secured to or integral with body member 41. The hub portion 81 has a side wall 88 and a top wall 89. The top wall 89 may have an opening 90 therein. Turret 46 further includes a bearing 82 and an inner swivel member 83. The member 83 has a first portion 85 which fits within the cavity 81*a* defined by member 81 and preferably is frustoconical in shape. The member 83 has an upwardly extending ladder support 84 which is disposed in opening 90. Support 84 has an opening 86 therein. A bolt may extend through opening 75 in hub 74 and through opening 86 in ladder support 84 thereby securing the aerial ladder 44 to turret 46**.

The loose ladder 91 may include a first section 92 and a second section 93 which in combination provide an extension ladder. The ladder section 93 may have several devices 94 which hold the ladder sections 92, 93 together. The extension ladder 91 has a pair of downwardly extending tabs 96 which may be inserted into slots 39 in intermediate body member 31.

ASSEMBLY OF THE TOY FIRE ENGINE TRAILER

The fire engine trailer 10 is assembled by first inserting turret member 83 into cavity **81*a* of turret member 81 with ladder support 84 extending through the opening 90. Bearing 82 is mounted on turret member 81 and around ladder support 84. Ladder section 64 is mounted in ladder section 63 and the entire aerial ladder 44 is secured to ladder support 84 as by bolt 87. Wheel and axle assembly 12 is assembled with wheels 13 and 14 being mounted on axle 16 and held thereon by friction. The axle 16 is then disposed in slots 23 and 24. The intermediate frame 31 is then secured to lower frame 11 thereby locking the wheel and axle assembly in place. Intermediate body frame 31 is attached to lower body frame 11 with tabs 36 extending through openings 28. The tabs 36 are then distorted such as by bending to lock the frames 11 and 31 together. upper body member 41 is then mounted over intermediate body frame 31 and screws or bolts inserted into openings 61 and 29**, thereby locking the entire assembly together.

The fire engine trailer 10 may be then attached to the fire engine tractor (not shown). The ladder 91 may be inserted into or between the ladder carrier members 47 with the projections 96 inserted into slots 39. The toothed hub 74 frictionally engages the bearing 82 in such a manner that aerial ladder 44 may be raised to any desired angular position and held in such position by the friction. Further, the aerial ladder 44 may be rotated on the turret 46 in any desired position.

Various modifications may be made without departing from the broader scope of the present invention. For example, the present turret may be provided on a straight truck-type fire engine.

The toy fire engine 10 (FIG. II) may be packaged in a carton 101 including a bottom panel 102, a top panel 103 and four side panels 104. The side panel which faces forwardly may include a conventional package window of cellophane so that the toy fire engine 10 may be observed. The present fire engine 10 is particularly advantageous in such arrangement due to the present mounting of the loose ladder 91. Conventional toy fire engines have hung the loose ladder on the exposed side of the fire engine. Commonly, the cellophane window may be broken and the loose ladder lost due to shoplifting. The loose ladder 91 of the present invention, when disposed in the ladder carrier, cannot be removed through a cellophane window in a side panel. Instead, the loose ladder can only be removed through the rear end of the fire engine. A sealed end panel thus discourages shoplifting of the loose ladder.

The present invention of course, possesses various other advantages which are apparent from the description of the present invention.

What is claimed is:

1. A toy fire engine comprising a body, wheel and axle assembly, aerial ladder and turret means, said turret means comprising:

a first turret member including a frustoconical side wall and a substantially flat upper wall, said side wall being intermediate said body and said upper wall, said side wall being integral with both said body and said upper wall, said side wall and said upper wall defining a cavity;

a second member including a frustoconical portion and an integral upwardly extending ladder support, said frustoconical portion being disposed within the cavity defined by said first member for rotational movement therein, said ladder support extending through said opening in said upper wall;

locking means for securing said second member within said first member and for securing said aerial ladder to said ladder support;

whereby said second member may be rotated within said first member thereby pivoting said aerial ladder about a central axis.

2. The toy fire engine of claim 1 wherein said aerial ladder comprises at least a pair of ladder sections and wherein one of said ladder sections includes a toothed side member and the other of said pair carries a wheel and gear assembly for driving engagement with said toothed side member.

3. The fire engine of claim 1 wherein said turret means includes a bearing member disposed between said upper wall and said aerial ladder for sliding engagement with said upper wall.

4. The fire engine of claim 3 wherein said aerial ladder includes means for locking said aerial ladder in various inclined positions.

5. The fire engine of claim 4 wherein said means for locking said aerial ladder comprise friction means.

6. A toy fire engine comprising body means, wheel and axle assembly, aerial ladder and loose ladder, said body means including ladder carrying means comprising lateral guide means for limiting sideward movement of said loose ladder when said loose ladder is disposed in said ladder carrying means, said ladder carrying means further including slot means, said loose ladder including at least one outwardly extending locking flange for engagement in said slot means thereby limiting forward and rearward movement of said ladder when disposed in said carrying means.

7. The toy fire engine of claim 6 wherein said fire engine includes turret means, said turret means comprising:

a first turret member including a frustoconical side wall and a substantially flat upper wall, said side wall being intermediate said body and said upper wall, said side wall being integral with both said body and said upper wall, said side wall and said upper wall defining a cavity;

a second member including a frustoconical portion and an integral upwardly extending ladder support, said frustoconical portion being disposed within the cavity defined by said first member for rotational movement therein, said ladder support extending through said opening in said upper wall;

locking means for securing said second member within said first member and for securing said aerial ladder to said ladder support;

whereby said second member may be rotated within said first member thereby pivoting said aerial ladder about a central axis.

8. A toy vehicle comprising a body, wheel and axle assembly and turret means, said turret means comprising:

a first turret member including a frustoconical side wall means and a substantially flat upper wall means, said side wall means being intermediate said body and said upper wall means, said side wall means being in locked engagement with both said body and said upper wall means, said side wall means and said upper wall means defining a cavity;

a second member including a frustoconical portion and an upwardly extending support means, said frustoconical portion being disposed within the cavity defined by said first member for rotational movement therein, said support means extending through said opening in said upper wall means;

locking means for securing said second member within said first member;

whereby said second member may be rotated within said first member thereby pivoting said support means.

9. The toy vehicle of claim 8 wherein said support means is an aerial ladder support means.

10. The toy vehicle of claim 8 wherein said support means is a boom support means.

11. A toy vehicle including boom means and turret means for rotatably supporting said boom means, said turret means comprising a hub and a swivel member; said hub including side and top walls defining a cavity, said top wall having an opening therein; said swivel member having a body portion and an upwardly extending boom support portion, said body portion lying in and effectively filling said cavity for rotation therein; and means for securing said body portion in said cavity.

12. The toy vehicle of claim 11 wherein said hub is frustoconical in shape.

13. The toy vehicle of claim 11 wherein said boom comprises a toy ladder.

14. The toy vehicle of claim 13 wherein said ladder includes at least two sections and means for driving one section with respect to the other section, said drive means including a rack and pinion drive system, said rack being associated with one of said sections and said pinion being associated with the other of said sections.

15. The toy vehicle of claim 14 wherein said pinion comprises a shaft portion, a manipulatable wheel, a bearing and a gear-like wheel.

16. The toy vehicle of claim 15 wherein said other ladder section includes a thick side member with an opening therein for reception of said pinion, said opening including an enlarged zone and a smaller semi-circular zone, said enlarged zone being of sufficient size to permit movement of said gear-like wheel therethrough and said smaller zone being small enough to snugly support said bearing, said one ladder serving to hold said pinion drive in place in said smaller semi-circular zone.

* * * * *